US005614081A

United States Patent [19]

Carey et al.

[11] Patent Number: 5,614,081

[45] Date of Patent: Mar. 25, 1997

[54] METHODS FOR INHIBITING FOULING IN HYDROCARBONS

[75] Inventors: William S. Carey, Ridley Park; Jeffrey H. Peltier, King of Prussia, both of Pa.; Alan E. Goliaszewski, The Woodlands, Tex.

[73] Assignee: BetzDearborn Inc., Trevose, Pa.

[21] Appl. No.: 489,905

[22] Filed: Jun. 12, 1995

[51] Int. Cl.[6] ..... C10G 9/16

[52] U.S. Cl. ..... 208/48 AA; 208/48 R; 208/47; 585/3; 585/950

[58] Field of Search ..... 208/48 AA, 48 R, 208/47; 585/3, 950

[56] References Cited

U.S. PATENT DOCUMENTS

| | | | |
|---|---|---|---|
| 3,141,032 | 7/1964 | Friedman | 260/461 |
| 3,271,295 | 9/1966 | Gonzalez | 208/48 |
| 4,578,178 | 3/1986 | Forester | 208/48 AA |
| 4,775,458 | 10/1988 | Forester | 208/48 AA |
| 4,972,561 | 5/1990 | Forester | 252/389.22 |
| 5,059,335 | 10/1991 | Rizvi et al. | 252/32.5 |
| 5,171,420 | 12/1992 | Forester | 208/48 AA |
| 5,171,421 | 12/1992 | Forester | 208/48 AA |
| 5,171,466 | 12/1992 | Korosec | 252/51.5 A |
| 5,241,003 | 8/1993 | Degonia et al. | 525/123 |
| 5,342,505 | 8/1994 | Forester | 208/48 AA |
| 5,362,898 | 11/1994 | Telschow | 558/74 |

OTHER PUBLICATIONS

Chem.Abstr. 97:72,589z, "Diphospaspiro Compounds", p. 656.

Chem.Abstr. 89:111,404s, "Hydrogen Phosphonates", p. 81.

Chem.Abstr. 85:21,557g, "Organic Phosphorous Compounds. 69. Synthesis and Properties of Cyclic Phosphonate and Thiophosphonate Esters", p. 712.

Chem.Abstr. 86:44,388n, "Phosphoric Acid Esters, Phosphonic Acid Esters, and Their Mixtures", p. 26.

Chem.Abstr. 79:5,629c, "Synthesis of Organophosphorous Oligomers and Polymers by Polycondensation", p. 1.

*Primary Examiner*—Glenn A. Caldarola
*Assistant Examiner*—Bekir L. Yildirim
*Attorney, Agent, or Firm*—Alexander D. Ricci; Philip H. Von Neida

[57] ABSTRACT

Alkylphosphonate ester compounds or acids thereof are disclosed as effective fouling inhibitors in liquid hydrocarbonaceous medium undergoing processing at elevated temperatures.

9 Claims, No Drawings

METHODS FOR INHIBITING FOULING IN HYDROCARBONS

FIELD OF THE INVENTION

The present invention relates to methods for inhibiting fouling in liquid hydrocarbons. More particularly, the present invention relates to methods for inhibiting fouling in petroleum hydrocarbons and petrochemicals during their processing at elevated temperatures utilizing an alkylphosphonate ester or acid thereof.

BACKGROUND OF THE INVENTION

In the processing of petroleum hydrocarbons and feedstocks, such as petroleum processing intermediates, and petrochemicals and petrochemical intermediates, e.g., gas, oils, distillates, and residues including coker feeds, chlorinated hydrocarbons, recycled hydrocarbons, and olefin plant fluids such as deethanizer bottoms, the hydrocarbons are commonly heated to temperatures of 100° F to 1400° F, frequently from 390° F to 900° F. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products.

In many processes, the deposits reduce the bore of conduits and vessels to impede process throughput, impair thermal transfer, and clog filter screens, valves and traps. In the case of heat exchange systems, the deposits form an insulating layer upon the available surfaces to impede heat transfer and necessitate frequent shut-downs for cleaning. Moreover, these deposits reduce throughput, which results in a loss of production capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities, catalyst fines and clays/silts present therein and/or salt formation which are primarily composed of magnesium, calcium and sodium chloride salts. Catalysts involved in the formation of such condensates has been attributed to metal compounds such as copper or iron which are present as impurities or acids such as sulfonic acids or Lewis acids. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

Methods for providing antifoulant inhibition for hydrocarbons during their processing at elevated temperatures with polyalkenylsuccinimides is disclosed in Gonzalez, U.S. Pat. No. 3,271,295 and in Forester, U.S. Pat. Nos. 5,171,420; 5,171,421; and 5,342,505. The use of polyalkenylthiophosphonate esters is disclosed in Forester, U.S. Pat. Nos. 4,578,178; 4,775,458; and 4,972,561. In Forester '178, polyalkenylthiophosphonate esters are used to inhibit fouling deposit formation in a petroleum hydrocarbon during processing thereof at temperatures between 600° and 1000° F. These sulfur-containing esters have alkyl substituents with carbon chain lengths typically greater than 40, while the compounds of the present invention have carbon chain lengths of 40 or less.

In Forester '458 and '561, the same polyalkenylthiophosphonate esters are used in a multi-component composition along with corrosion inhibitors, antioxidants and metal deactivators to control the formation of fouling deposits.

SUMMARY OF THE INVENTION

Disclosed are methods for inhibiting fouling in hydrocarbons fluids during their processing at elevated temperatures. It has been discovered that certain alkylphosphonate esters or acids thereof are effective at inhibiting the formation of fouling deposits in liquid hydrocarbonaceous media during their high temperature processing.

DESCRIPTION OF THE RELATED ART

U.S. Pat. No. 3,141,032 teaches the preparation of dialkyl pentaerythritol diphosphonates by the Arbuzov rearrangement of the corresponding phosphites, i.e., dialkyl pentaerythritol diphosphites. These compounds were reported to be effective plasticizers, flame resistant lubricant oils, and flame retardant additives for polymers. Diphosphaspiro compounds similar in structure to the '032 compounds are also disclosed in Chemical Abstracts references 97:72,589z, 89:111,404s, and 85:21,557g.

Chemical Abstracts reference 86:44,388 discloses antistatic compositions prepared by reacting epoxides, namely glycidol, with phosphonic acid monoesters to yield alkylphosphonates consisting of hydroxyalkyl esters.

U.S. Pat. No. 5,362,898 discloses the preparation of bis(pentaerythritol phosphate alcohol) alkylphosphonate by the transesterification of a diphenyl alkylphosphonate with pentaerythritol phosphate alcohol. These compounds are taught to be useful as flame retardant additives for polymers.

Chemical Abstracts reference 79:5,629c discloses the preparation of polyurethanes from oligomeric reaction intermediates obtained by the transesterification of dialkyl phosphites ($HP{=}O(OR)_2$) with pentaerythritol or glycerol.

U.S. Pat. No. 5,171,466 discloses oil-soluble lubricant dispersant compositions formed by reacting an aliphatic hydrocarbyl substituted succinic acylating agent (i.e., polyisobutenylsuccinic anhydride, PIBSA) with a mixture consisting of a hydrocarbyl polyamine consisting of 50 to 90 weight percent cyclic polyalkene polyamine to yield polyalkenylsuccinimides, similar to those disclosed in U.S. Pat. No. 3,271,295. The '466 patent further states that the polyalkenylsuccinimides can be subject to a number of post-treating agents including phosphorous-containing materials. Exemplary phosphorous-containing post-treating agents include alkyl phosphites and phosphates, but not phosphonates.

U.S. Pat. No. 5,241,003 discloses the preparation of ester, amide, or ester-amide derivatives of PIBSA to yield compositions useful as ashless dispersants in lubricating oils and functional fluids. The '003 patent also states that other properties of the ester, amide, or esteramide derivatives of PIBSA, such as antiwear and passivity activity, can be improved by subjecting these PIBSA derivatives to a number of post-treating agents, including phosphorous-containing compounds.

U.S. Pat. No. 5,059,335 discloses compositions particularly useful for lubricating formulations comprising salts of alpha-hydroxy alkylphosphonic acids with basic materials selected from the group consisting of a detergent, a dispersant, a polyamine, or mixtures thereof.

These references pertain to compounds that are structurally different from the preferred inventive compositions. These references also fail to teach that the referenced compounds would have any efficacy as antifoulant compounds for petroleum hydrocarbons or petrochemicals during their processing at elevated temperatures.

DETAILED DESCRIPTION OF THE INVENTION

The present invention relates to a method for inhibiting fouling deposit formation in a liquid hydrocarbonaceous medium such as a petroleum hydrocarbon or petrochemical during processing at elevated temperatures, wherein in the absence of such treatment, fouling deposits are normally formed as a separate and distinct phase in the liquid hydrocarbonaceous medium, the method comprising adding to said medium an effective antifouling amount of an alkylphosphonate ester or acid thereof having an alkyl chain length of $C_1$ to $C_{40}$.

The alkylphosphonate esters or acids thereof useful in the present invention have the general structure:

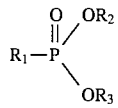

Formula I wherein $R_1$ is a $C_1$ to $C_{40}$ alkyl or alkenyl radical and $R_2$ and $R_3$ are either the same or different and are H or a substituted or non-substituted $C_1$ to $C_{40}$ alkyl or alkenyl radical.

In a preferred embodiment of the present invention, $R_1$ is a $C_4$ to $C_{30}$ alkyl radical and $R_2$ and $R_3$ are the same or different and are $C_1$ to $C_5$ alkyl radicals. In a more preferred embodiment, $R_1$ of Formula I is a $C_4$ to $C_{30}$ n-alkyl radical and $R_2$ and $R_3$ are the same or different and are $C_1$ to $C_2$ alkyl radicals.

The alkylphosphonate esters of the present invention may also be represented by the general structure:

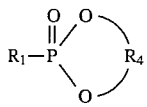

Formula II wherein $R_1$ is a $C_1$ to $C_{40}$ alkyl or alkenyl radical and $R_4$ is a substituted or non-substituted alkyl or alkenyl radical having 1 to 40 carbon atoms. In a preferred embodiment of Formula II, $R_1$ is a $C_4$ to $C_{30}$ alkyl radical and $R_4$ is a hydroxy substituted $C_2$ to $C_{10}$ alkyl radical.

In a more preferred embodiment of this invention, $R_1$ of Formula II is a $C_4$ to $C_{30}$ n-alkyl radical and $R_4$ is —$CH_2CH$—($CH_2OH$) or—$CH_2CHOHCH_2$— or (—$CH_2)_2C(CH_2OH)_2$. In these novel compositions, $R_1$ is most preferably $C_{12}$ to $C_{18}$.

The alkylphosphonate esters of the present invention can be prepared by a number of synthetic methods known to those skilled in the art. For example, compounds of the present invention can be prepared by Michaelis-Arbuzov reaction of phosphites with halogenated materials, or by radical addition of phosphites with alkenes.

Preferably, the compounds of the present invention are prepared by radical addition of a dialkyl phosphite to an alkene to yield dialkyl alkylphosphonate esters represented by Formula I. These compounds can then be further functionalized by transesterification with suitable reagents known to those skilled in the art, to yield compositions represented by Formula I and Formula II. Exemplary compounds include but are not limited to pentaerythritol and glycerol.

The radical addition of the dialkyl phosphite with the alkene may proceed in the presence of a free radical initiator either neat or in solution. Conventional initiators such as peroxides, azo compounds, and UV light may be used. Exemplary dialkyl phosphite compounds include but are not limited to diethyl and dimethyl phosphite. Exemplary alkene compounds include but are not limited to $C_2$ to $C_{30}$ α olefins and mixtures thereof.

It will be appreciated that in the course of the preferred synthesis scheme certain by-products may be produced along with the compounds of the present invention. For example, the radical addition of phosphite with $C_2$ to $C_{30}$ alpha olefins can result in polymeric structures as represented by Formula III.

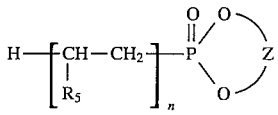

Formula III wherein $R_5$ is the residual after polymerization of a $C_2$ to $C_{30}$ α olefin, n is an integer greater than 1 and Z is a combination of $R_2$ and $R_3$, or $R_4$ which are as previously defined.

If desired, the reaction conditions utilized during the radical addition of dialkyl phosphite with the alkene can be modified to minimize the generation of polymeric species represented by Formula III. The nonpolymeric reaction products can also be readily recovered by known methods; however, it is feasible and economical to employ the compounds of the present invention without separation or purification for removal of these by-products.

It is to be understood that the phrase "liquid hydrocarbonaceous medium" as used herein signifies various and sundry petroleum hydrocarbons and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil and vacuum residual, as well as slurrys and recycled fractions or combinations are all included in this definition.

Similarly, petrochemicals such as olefinic or naphthenic process streams, aromatic hydrocarbons and their derivatives, ethylene dichloride and ethylene glycol are all considered to be within the ambit of the phrase "liquid hydrocarbonaceous medium".

The alkylphosphonate ester compounds of the present invention prove effective in liquid hydrocarbonaceous media having temperatures from 100° up to 1400° F. The compounds of the present invention are particularly effective in hydrocarbonaceous media at temperatures greater than 450° F, where the rates of fouling are generally accelerated.

Temperatures from 390° to 900° F are often found in hydrocarbons during their processing and the compounds of the present invention are more particularly effective under these conditions.

The alkylphosphonate ester compounds or acids thereof of the present invention may be added to or dispersed within the liquid hydrocarbonaceous medium in an amount of about 1 part to about 2000 parts per million parts of the liquid hydrocarbonaceous medium. Preferably, the alkylphosphonate ester compounds may be added in an amount ranging from about 2 parts to about 200 parts per million parts of liquid hydrocarbonaceous medium to be treated.

The alkylphosphonate ester compounds or acids thereof of the present invention may also be desirably employed in a multi-component antifouling composition. The other components may comprise an antioxidant compound which inhibits oxygen based polymerization or condensation in hydrocarbons; corrosion inhibiting compounds; additional antifouling compounds; and metal deactivator compounds which deactivate metals such as copper and iron which otherwise would catalyze polymerization of impurities in the hydrocarbon.

The invention will now be described with reference to a number of specific examples which are to be regarded solely as illustrative of the methods and compositions of this invention and not as restricting the scope thereof.

EXAMPLES

Synthesis of the alkylphosphonate esters

Preparation of diethyl dodecylphosphonate:

Example 1

To a dry reaction flask equipped with a mechanical stirrer, thermometer, reflux condenser, addition port, and a nitrogen blanket were charged with 1-dodecene (95%, 40.0 g, 0.226 mole) and diethyl phosphite (98%, 38.18 g, 0.2710 mole). The resulting solution was purged of oxygen with nitrogen then benzoyl peroxide (97%, 1.41 g, 0.0056 mole) was charged to the reactor. The reactor contents were then heated at 80° C for 16 hours. After heating, an in-process sample was analyzed by $^{13}C$ and $^{31}P$ NMR spectroscopy, then residual 1-dodecene and diethyl phosphite were removed by vacuum distillation to yield 61.64 g of a light yellow tinted clear liquid.

The structure of the desired product was confirmed by $^{13}C$ and $^{31}P$ NMR spectroscopy. The $^{31}P$ NMR spectrum was characterized by major peaks at 32.0(s) and 32.1(s) ppm downfield from an external phosphoric acid reference. The product peak integrated to be 88.6% of the total phosphorous species in the sample. Traces of residual diethyl phosphite (5.7%, 7.6 ppm) and other minor phosphorous containing species were also detected at 34.5 ppm (3.6%), 5.0 ppm (1.5%) and 0.2 ppm (0.6%). The $^{13}C$ NMR spectrum was characterized by peaks at 61.1(s), 23–33(m), 23.2(s), 16.9(s), 14.5(s), and the lack of peaks at 114.7 and 139.3 ppm downfield from an external dioxane standard. The final product was estimated to consist of a mole ratio of 1-dodecene to reacted diethyl phosphite of 1.44:1.0 and contain 8.85 weight percent total phosphorous.

Transesterification of diethyl dodecylphosphonate with pentaerythritol:

Example 2

To a dry reaction flask equipped with a mechanical stirrer, thermometer, distillation column, condenser, receiver, addition port, and a nitrogen blanket were charged the product of Example 1 (61.64 g) and pentaerythritol (98%, 25.99 g, 0.1871 mole). The resulting fluid slurry was purged of oxygen with nitrogen, then heated at 225° C for 80 minutes to yield a golden yellow tinted viscous liquid. During the hold at 225° C, 13.6 g of distillate was collected in the receiver.

The structure of the desired product was confirmed by $^{13}C$ and $^{31}P$ NMR spectroscopy. The $^{31}P$ NMR spectrum was characterized by a broad peak at 30.9 ppm downfield from an external phosphoric acid reference. The $^{13}C$ NMR spectrum was characterized by lack of peaks at 61.1 and 16.9 ppm downfield from external dioxane reference. The total weight percent phosphorous of the final product was estimated to be 7.42 percent.

Various other dialkyl alkylphosphonates were prepared by the methods of Example 1, and transesterified with pentaerythritol and glycerol according to the method of Example 2. A summary of the materials prepared is presented in Table I.

TABLE I

Alkyl Phosphonate Composition Summary

| Composition No. | Alkyl Group | Ester Group | Mole Ratio[1] | Wt % P[2] |
|---|---|---|---|---|
| 1 | $C_8H_{17}$ | pentaerythritol | 1.18:1.00 | 9.29 |
| 2 | $C_8H_{17}$[3] | pentaerythritol | 1.33:1.00 | 9.60 |
| 3 | $C_{12}H_{25}$ | diethyl | 1.54:1.00 | 7.61 |
| 4 | $C_{12}H_{25}$ | pentaerythritol | 1.44:1.00 | 7.42 |
| 5 | $C_{12}H_{25}$ | glycerol | 1.54:1.00 | 7.92 |
| 6 | $C_{18}H_{37}$ | pentaerythritol | 1.67:1.00 | 4.97 |
| 7 | $C_{18}H_{37}$ | glycerol | 1.67:1.00 | 5.31 |

[1]alkene to reacted phosphite mole ratio
[2]total weight percent phosphorous for the product
[3]prepared by esterification of octylphosphonic acid

HLPS Antifoulant Test

The Hot Liquid Process Simulator (HLPS) apparatus was utilized to determine the antifouling efficacy in crude oil of the inventive compounds. The HLPS consists of an electrically heated rod fixed within a tube with close annular clearance which performs as a heat exchanger. In the test a process fluid is passed once-through the heat exchanger while maintaining the rod temperature constant. As fouling occurs on the rod, less heat is transferred to the fluid which results in a decrease in the process fluid outlet temperature. Antifoulant protection is determined by calculating the areas under the heat transfer curves for control and treated runs. U-coefficients of heat transfer are calculated every 2 minutes during the test by measuring the temperatures of the process fluid and the heated rod at the inlet (cold end) and outlet (hot end) of the exchanger. From these U-coefficients, areas under the fouling curves are calculated and subtracted from the nonfouling curves. Comparing the areas of the control runs (average) and treated runs in the following equation results in a percent protection value for the antifoulant treatment.

$$\% \text{ Protection} = \frac{\text{Avg. } \Delta \text{ area (control)} - \Delta \text{ area (treatment)}}{\text{Avg. } \Delta \text{ area (control)}} \times 100$$

The results of this testing for various compositions of Table I as well as comparative treatment PETPA (U.S. Pat. No. 4,578,178, Forester) are presented in Table II.

TABLE II

| HLPS Test Crude Oil/ Rod Temp. | Treatment | Dose (ppm as P)[1] | % Protection |
|---|---|---|---|
| 1/325° F. | Composition 4 | 2.50 | 1 |
| | | 7.43 | 34 |
| | PETPA | 1.75 | none |
| 2/350° F. | Composition 3 | 9.48 | none |
| | | 30.40 | 25 |
| | Composition 4 | 18.56 | none |
| | Composition 5 | 9.30 | 15 |
| | Composition 6 | 6.17 | 38 |
| | Composition 7 | 8.90 | 32 |
| | PETPA | 3.50 | 49 |
| | | 7.00 | 31 |
| 3/275° F. | Composition 3 | 9.48 | 90 |
| | Composition 5 | 4.65 | 97 |
| | Composition 6 | 9.95 | 85 |
| | | 4.45 | none |
| | | 4.45 | none |
| | Composition 7 | 10.60 | 64 |
| | | 4.45 | 94 |
| | PETPA | 3.50 | 59 |
| 4/450° F. | Composition 4 | 0.18 | 70 |
| | | 0.35 | 12 |
| | | 0.53 | 31 |
| | PETPA | 0.18 | none |
| | | 0.35 | 42 |
| 4/475° F. | Composition 4 | 0.35 | 23 |
| | | 0.70 | 10 |
| | | 0.70 | 48 |
| | | 1.04 | none |
| | | 2.08 | none |
| | PETPA | 0.18 | none |
| | | 0.35 | 81 |
| | | 0.35 | none |
| | | 0.70 | 31 |
| 5/350° F. | Composition 4 | 2.45 | none |
| | Composition 6 | 2.49 | none |
| | PETPA | 1.75 | 48 |
| 6/340° F. | PETPA | 1.75 | none |
| | Composition 5 | 5.60 | none |

[1]Dose is the amount of phosphorous by weight, dose of actives will of course depend on composition molecular weight
Crude 1 is from a Midwestern refinery
Crude 2 is from a Canadian refinery
Crude 3 is from a Canadian refinery
Crude 4 is from a Eastern refinery
Crude 5 is from a Midwestern refinery
Crude 6 is from a Midwestern refinery Pressurized Hot Filament Fouling Test (PHFFT)

The PHFFT was used to determine the antifouling efficacy of the alkylphosphonate esters of the present invention in fluidized-bed catalytic cracking (FCC) fractionation train bottoms. Charged to a pressure vessel was 500 mLs of the test fluid or the test fluid containing treatment. Submerged into the fluid is a set of electrodes holding a preweighed nichrome wire. The vessel is seated with the electrodes held in place by Teflon spacers. After pressurizing the vessel to 200 psig with nitrogen, current is applied to the electrodes which results in heating of the nichrome wire. After the test period, current is disconnected and the vessels cooled to 120° F. After releasing the pressure, the wire is retrieved, rinsed with xylene, and permitted to dry. The weight of the wire is determined along with deposit from the vessel isolated by filtration.

The deposit weight for a given test was calculated according to the following equation:

$$Wt.\ deposit = [(Wt.\ wire + deposit) - (original\ wire\ wt.)]$$

The percent protection was then calculated by comparing the deposit weight of the control runs (average) and the treated runs according to the following equation.

$$\% \text{ Protection} = \frac{\text{Avg. deposit wt. (control)} - \text{deposit wt. treatment}}{\text{Avg. deposit wt. (control)}} \times 100$$

The results of this testing are reported in Table III.

TABLE III

| PHFFT Treatment | Slurry | Dose (ppm as P) | % Protection |
|---|---|---|---|
| PETPA | 1 | 1.75 | 68,43 |
| Composition 4 | 1 | 4.63 | 68 |
| Composition 5 | 1 | 5.60 | 67 |
| Composition 5 | 1 | 11.20 | 73 |
| PETPA | 2 | 1.40 | 99 |
| Composition 6 | 2 | 2.48 | 98 |
| Composition 7 | 2 | 2.65 | 98 |
| Composition 4 | 2 | 3.71 | 96 |
| Composition 3 | 2 | 3.80 | 100 |
| Composition 5 | 2 | 4.65 | 55 |
| PETPA | 2a | 1.05 | none |
| Composition 5 | 2a | 3.36 | none |
| PETPA | 3 | 1.75 | 78 |
| PETPA | 3 | 3.50 | 62 |
| Composition 5 | 3 | 5.60 | 95,92 |
| Composition 5 | 4 | 3.36 | 93 |

Slurry 1 is from an Eastern refinery; 7 AMPS for 24 hours
Slurry 2 is from a Gulf Coast refinery; 6 AMPS for 18 hours
Slurry 2a is from a Gulf Coast refinery; 7 AMPS for 24 hours
Slurry 3 is from a Gulf Coast refinery; 7 AMPS for 24 hours
Slurry 4 is from an Eastern refinery; 7 AMPS for 18 hours This testing demonstrates that the alkylphosphonate esters of the present invention are as effective as the known inhibitor PETPA as taught in Forester '178 at inhibiting fouling in FCC fractionating drain bottoms. This testing also demonstrates the unexpected results occasioned by use of this invention. The effectiveness of the shorter alkyl chain lengths, particularly $C_8$ to $C_{18}$, was surprising when compared with the longer chain lengths of the known antifoulants. The effectiveness of the inventive compounds is also surprising in light of their containing no sulfur species which the literature teaches is necessary for antifouling activity and is demonstrated by the PETPA compounds of Forester.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method for inhibiting fouling deposit formation in a liquid hydrocarbonaceous medium during processing at temperatures from 300° F to 1400° F comprising adding to said liquid hydrocarbonaceous medium an effective antifouling amount of an alkylphosphonate ester or acid thereof having an alkyl chain length of $C_1$ to $C_{40}$.

2. The method as claimed in claim 1 wherein said alkylphosophonate ester or acid thereof has the formula:

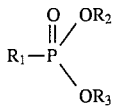

wherein $R_1$ is a $C_1$ to $C_{40}$ alkyl or alkenyl radical and $R_2$ and $R_3$ are either the same or different and are H or a substituted or non-substituted $C_1$ to $C_{40}$ alkyl or alkenyl radical.

3. The method as claimed in claim 2 wherein $R_1$ in said formula is $C_4$ to $C_{30}$ alkyl radical and $R_2$ and $R_3$ are the same or different and are $C_1$ to $C_5$ alkyl radicals.

4. The method as claimed in claim 2 wherein $R_1$ in said formula is a $C_4$ to $C_{30}$ n-alkyl radical and $R_2$ and $R_3$ are the same or different and are $C_1$ to $C_2$ alkyl radicals.

5. The method as claimed in claim 1 wherein said alkylphosphonate ester has the formula:

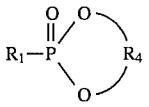

wherein $R_1$ is a $C_1$ to $C_{40}$ alkyl or alkenyl radical and $R_4$ is a substituted or non-substituted alkyl or alkenyl radical having 1 to 40 carbon atoms.

6. The method as claimed in claim 5 wherein $R_1$ is a $C_4$ to $C_{30}$ alkyl radical and $R_4$ is a hydroxy substituted $C_2$ to $C_{10}$ alkyl radical.

7. The method as claimed in claim 5 wherein $R_1$ is a $C_4$ to $C_{30}$ n-alkyl radical and $R_4$ is selected from the group consisting of $—CH_2CH—(CH_2OH)$, $—CH_2CHOHCH_2—$ and $(—CH_2)_2C(CH_2OH)_2$.

8. The method as claimed in claim 1 wherein said alkylphosphonate ester is added to said liquid hydrocarbonaceous medium in an amount ranging from about 1 part to about 2000 parts per million parts of liquid hydrocarbonaceous medium.

9. The method as claimed in claim 1 wherein said hydrocarbonaceous medium is at a temperature of about 390° F to about 800° F.

* * * * *